US010815982B2

(12) United States Patent
Matsui

(10) Patent No.: US 10,815,982 B2
(45) Date of Patent: Oct. 27, 2020

(54) CRYOPUMP SYSTEM AND METHOD OF OPERATING CRYOPUMP SYSTEM

(71) Applicant: Sumitomo Heavy Industries, Ltd., Tokyo (JP)

(72) Inventor: Takaaki Matsui, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 579 days.

(21) Appl. No.: 14/547,665

(22) Filed: Nov. 19, 2014

(65) Prior Publication Data

US 2015/0135735 A1 May 21, 2015

(30) Foreign Application Priority Data

Nov. 20, 2013 (JP) ..... 2013-239757

(51) Int. Cl.
*F04B 37/08* (2006.01)

(52) U.S. Cl.
CPC ..... *F04B 37/08* (2013.01)

(58) Field of Classification Search
CPC ..... F04B 37/08
USPC ..... 62/55.5
See application file for complete search history.

(56) References Cited

U.S. PATENT DOCUMENTS

2002/0051719 A1* 5/2002 Shiibayashi ..... F04C 18/0276 418/55.2
2003/0014985 A1 1/2003 Dresens et al.
2007/0107448 A1 5/2007 Dresens et al.
2009/0282842 A1 11/2009 Koyama
2010/0313583 A1 12/2010 Dresens et al.
2011/0016890 A1* 1/2011 Kimura ..... F04B 37/08 62/55.5
2011/0147198 A1 6/2011 Okada et al.
2012/0060519 A1* 3/2012 Tanaka ..... F04B 37/085 62/55.5
2012/0067065 A1* 3/2012 Ando ..... F04B 37/08 62/55.5
2012/0304668 A1* 12/2012 Xu ..... F25B 9/14 62/6
2013/0019620 A1 1/2013 Dresens et al.
2013/0160468 A1 6/2013 Kimura
2013/0232999 A1 9/2013 Matsui
(Continued)

FOREIGN PATENT DOCUMENTS

CN 101963144 A 2/2011
JP S61-265461 A 11/1986
(Continued)

*Primary Examiner* — Brian M King
(74) *Attorney, Agent, or Firm* — Michael Best & Friedrich LLP

(57) ABSTRACT

A cryopump system includes at least one cryopump including a refrigerator including a low temperature cooling stage and a high temperature cooling stage, a low temperature cryopanel cooled by the low temperature cooling stage, and a high temperature cryopanel cooled by the high temperature cooling stage. A compressor unit includes a compressor main body that compresses a working gas supplied to the refrigerator, an operating frequency of the compressor main body being variable. The compressor unit is operated such that a pressure ratio between high pressure and low pressure of the compressor main body is in a range between 1.6 and 2.5.

16 Claims, 4 Drawing Sheets

(56) References Cited

U.S. PATENT DOCUMENTS

| | | | |
|---|---|---|---|
| 2015/0040596 | A1 | 2/2015 | Dresens et al. |
| 2015/0135735 | A1 | 5/2015 | Matsui |

FOREIGN PATENT DOCUMENTS

| | | | |
|---|---|---|---|
| JP | H04-278147 | A | 10/1992 |
| JP | H10-132405 | A | 5/1998 |
| JP | H11-108479 | A | 4/1999 |
| JP | 2000-249056 | A | 9/2000 |
| JP | 2002-243294 | A | 8/2002 |
| JP | 2003-113779 | A | 4/2003 |
| JP | 2005-283026 | A | 10/2005 |
| JP | 2009-275579 | A | 11/2009 |
| JP | 2012-047368 | A | 3/2012 |
| JP | 2012-237262 | A | 12/2012 |
| JP | 2013-134020 | A | 7/2013 |
| JP | 2013-185480 | A | 9/2013 |
| JP | 2015-098844 | A | 5/2015 |
| JP | 2012-214936 | A | 12/2017 |
| TW | 201303162 | A | 1/2013 |
| WO | WO-2010-038415 | A1 | 4/2010 |
| WO | WO-2012122114 | A2 | 9/2012 |

* cited by examiner

CRYOPUMP SYSTEM AND METHOD OF OPERATING CRYOPUMP SYSTEM

RELATED APPLICATION

Priority is claimed to Japanese Patent Application No. 2013-239757, filed on Nov. 20, 2013, the entire content of which is incorporated herein by reference.

BACKGROUND OF THE INVENTION

Field of the Invention

The present invention relates to a cryopump system and a method of operating a cryopump system.

Description of the Related Art

A cryopump system includes at least one cryopump and one or a plurality of compressor units. The cryopump includes a refrigerator. The compressor unit supplies a working gas to the refrigerator. The working gas expands in the refrigerator and cools the cryopump accordingly. The working gas is collected to the compressor unit.

SUMMARY OF THE INVENTION

An illustrative purpose of an embodiment of the invention is to improve the energy saving performance of a cryopump system.

According to an aspect of the present invention, a cryopump system is provided, which includes: at least one cryopump including a refrigerator including a low temperature cooling stage and a high temperature cooling stage, a low temperature cryopanel cooled by the low temperature cooling stage, and a high temperature cryopanel cooled by the high temperature cooling stage; a compressor unit including a compressor main body that compresses a working gas to be supplied to the refrigerator, an operating frequency of the compressor main body being variable. The compressor unit is operated such that a pressure ratio between high pressure and low pressure of the compressor main body is in a range between 1.6 and 2.5.

According to an aspect of the present invention, a method of operating a cryopump system is provided. The cryopump system includes: at least one cryopump including a refrigerator including a low temperature cooling stage and a high temperature cooling stage, a low temperature cryopanel cooled by the low temperature cooling stage, and a high temperature cryopanel cooled by the high temperature cooling stage; and a compressor unit including a compressor main body that compresses a working gas to be supplied to the refrigerator, an operating frequency of the compressor main body being variable. The method includes operating the compressor main body such that a pressure ratio between high pressure and low pressure of the compressor main body is in a range between 1.6 and 2.5.

Optional combinations of the aforementioned constituting elements, and implementations of the invention in the form of methods, apparatuses, and systems may also be practiced as additional modes of the present invention.

BRIEF DESCRIPTION OF THE DRAWINGS

Embodiments will now be described, by way of example only, with reference to the accompanying drawings that are meant to be exemplary, not limiting, and wherein like elements are numbered alike in several figures, in which.

DETAILED DESCRIPTION OF THE INVENTION

Figure 1:
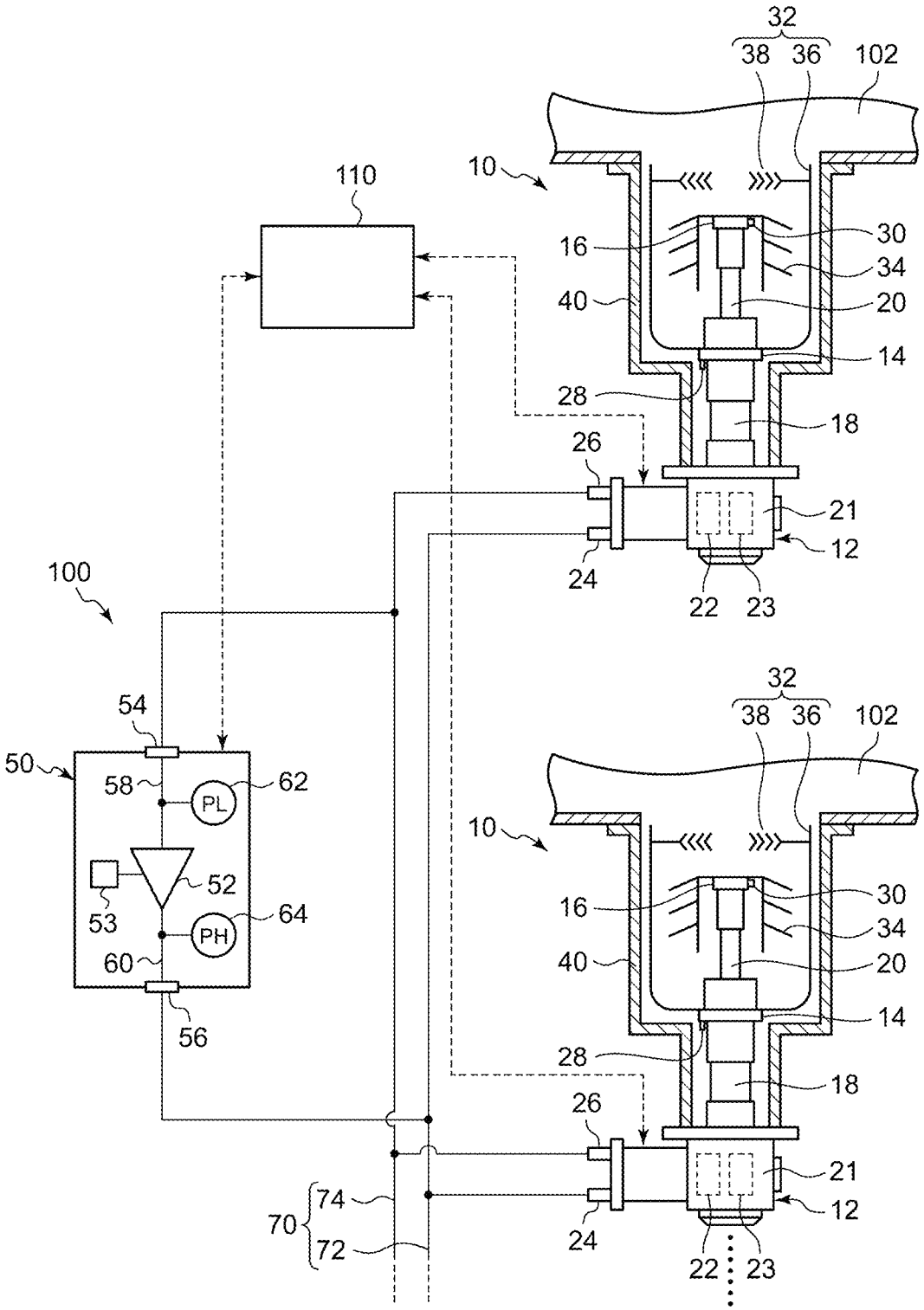
FIG. 1 is a diagram schematically illustrating an overall configuration of a cryopump system according to an embodiment of the present invention.

The invention will now be described by reference to the preferred embodiments. This does not intend to limit the scope of the present invention, but to exemplify the invention.

A detailed description of an embodiment to implement the present invention will be given with reference to the drawings. Like numerals are used in the description to denote like elements and the description is omitted as appropriate. The structure described below is by way of example only and does not limit the scope of the present invention.

The cryopump system according to an embodiment of the present invention includes a cryopump provided including a two-stage refrigerator, and a compressor for supplying a high pressure working gas to the refrigerator. The refrigerator is configured such that the refrigeration work Q is adjustable by, for example, controlling the operating frequency of the refrigerator. The compressor is configured such that the compression work W is adjustable by, for example, controlling the operating frequency of the compressor.

The inventor has theoretically analyzed the system in light of the fact that the working gas is a real gas. The inventor has consequently found out that the efficiency of the refrigerator (hereinafter, also referred to as refrigeration efficiency) $\varepsilon$ is maximum when the compressor is operated at a certain pressure ratio, in the temperature zone of the low temperature stage of the refrigerator. The efficiency $\varepsilon$ of the refrigerator is given by $\varepsilon=Q/W$. As described later, the optimum pressure ratio falls within a range from about 1.6 to about 2.5, for example. Therefore, the power consumption of the system can be reduced by operating the compressor within this range.

Meanwhile, some typical cryopump systems are designed, giving the refrigeration work Q of the refrigerator a high weight. For example, systems are designed such that the refrigeration work Q is maximized. The resultant operating pressure ratio of the compressor is normally about, for example, about 2.6 or higher, which is outside the optimum range indicated above.

In certain embodiments, the lowest operating frequency of the compressor is defined by the specification of the compressor. When the compressor is operated at the lowest operating frequency, the working gas is supplied from the compressor to the refrigerator with the minimum flow rate associated with the lowest operating frequency. If the flow rate of the working gas used in the refrigerator is smaller than the minimum flow rate, the working gas will be supplied from the compressor to the refrigerator excessively. In this state, more than necessary electric power is consumed in the compressor.

In order to mitigate imbalance between the flow rates of the working gas that could occur between the compressor and the refrigerator due to the specification of the compressor, the cryopump system according to an embodiment of the present invention may include a plurality of cryopumps and each cryopump may include a two-stage refrigerator. In this case, the flow rate of the working gas used in the refrigerator is larger than when the system includes only one cryopump so that the compressor is rarely operated in an operating state in which the flow rate of the working gas drops to minimum. For this reason, the operating frequency of the compressor can be adjusted over the entire operating period of the compressor or over a majority of the period. Thereby, the working gas is supplied from the compressor to the refrigerator so as to balance the flow rate of the working gas used in the refrigerator. Accordingly, consumption of extra power due to the specification as described above is prevented or mitigated.

FIG. 1 is a diagram schematically illustrating an overall configuration of a cryopump system 100 according to an embodiment of the present invention. The cryopump system 100 is used to remove gases to generate a vacuum in a vacuum chamber 102. The vacuum chamber 102 is provided to provide a vacuum environment for a vacuum processing apparatus (for example, an apparatus used for manufacturing semiconductors, such as ion implanters and sputtering instruments).

The cryopump system 100 includes a plurality of cryopumps 10 and a compressor or a compressor unit 50. The cryopump system 100 also includes a gas line 70 connecting the plurality of cryopumps 10 to the compressor unit 50 in parallel. The gas line 70 is configured to circulate the working gas between the plurality of cryopumps 10 and the compressor unit 50.

The cryopump 10 is attached to the vacuum chamber 102 and used to increase the degree of vacuum in the chamber to a desired level. Another cryopump 10 may be mounted to the vacuum chamber 102 evacuated by the cryopump 10. Alternatively, a given cryopump 10 and another cryopump 10 may be mounted to different vacuum chambers 102.

The cryopump 10 includes a refrigerator 12. The refrigerator 12 is a cryogenic refrigerator, such as a Gifford-McMahon type refrigerator (generally called a GM refrigerator). The refrigerator 12 is of two-stage type including a high temperature cooling stage or a first stage 14, and a low temperature cooling stage or a second stage 16.

The refrigerator 12 includes a first cylinder 18 defining therein a first stage expansion chamber and a second cylinder 20 defining therein a second stage expansion chamber that communicates with the first stage expansion chamber. The first cylinder 18 and the second cylinder 20 are connected in series. The first cylinder 18 connects a motor housing 21 to the first stage 14, and the second cylinder 20 connects the first stage 14 to the second stage 16. A first displacer and a second displacer (not shown) are built in the first cylinder 18 and the second cylinder 20, respectively. The first displacer and the second displacer are mutually connected. The first displacer and the second displacer each include a built-in regenerator therein.

The motor housing 21 of the refrigerator 12 accommodates a refrigerator motor 22 and a gas channel switching mechanism 23. The refrigerator motor 22 provides a driving force for the first and second displacers, and the gas channel switching mechanism 23. The refrigerator motor 22 is connected to the first displacer and the second displacer such that the first displacer and the second displacer can reciprocate in the first cylinder 18 and the second cylinder 20, respectively.

The gas channel switching mechanism 23 is configured to cyclically switch a channel of the working gas in order to repeat the expansion of the working gas in the first stage and second stage expansion chambers cyclically. The refrigerator motor 22 is connected to a movable valve (not shown) of the gas channel switching mechanism 23 such that the valve can be operated in forward and reverse directions. The movable valve is, for example, a rotary valve.

The motor housing 21 includes a high pressure gas inlet 24 and a low pressure gas outlet 26. The high pressure gas inlet 24 is formed at an end of a high pressure channel of the gas channel switching mechanism 23, and the low pressure gas outlet 26 is formed at an end of a low pressure channel of the gas channel switching mechanism 23.

The refrigerator 12 derives, from the expansion therein of a high pressure working gas (helium, for example), cooling at the first stage 14 and the second stage 16. The high pressure working gas is supplied from the compressor unit 50 through the high pressure gas inlet 24 to the refrigerator 12. In this case, the refrigerator motor 22 switches the gas channel switching mechanism 23 such that the high pressure gas inlet 24 is connected to the expansion chambers. When the expansion chambers of the refrigerator 12 are filled with the high-pressure working gas, the refrigerator motor 22 switches the gas channel switching mechanism 23 such that the expansion chambers are connected to the low pressure gas outlet 26. The working gas is adiabatically expanded and discharged through the low pressure gas outlet 26 to the compressor unit 50. The first and second displacers reciprocate in the expansion chambers in synchronization with the operation of the gas channel switching mechanism 23. By repeating such a thermal cycle, the first stage 14 and the second stage 16 are cooled.

The second stage 16 is cooled to a temperature lower than that of the first stage 14. The second stage 16 is cooled to, for example, about 8 K to 20 K, and the first stage 14 is cooled to, for example, about 80 K to 100 K. The first stage 14 is provided with a first temperature sensor 28 for measuring the temperature of the first stage 14, and the second stage 16 is provided with a second temperature sensor 30 for measuring the temperature of the second stage 16.

The cryopump 10 includes a high temperature cryopanel or a first cryopanel 32, and a low temperature cryopanel or a second cryopanel 34. The first cryopanel 32 is fixed such that it is thermally connected to the first stage 14, and the second cryopanel 34 is fixed such that it is thermally connected to the second stage 16. Therefore, the first cryopanel 32 is cooled by the first stage 14, and the second cryopanel 34 is cooled by the second stage 16.

The first cryopanel 32 includes a heat shield 36 and a baffle 38 and encloses the second cryopanel 34. The second cryopanel 34 includes an adsorbent at least on a part of its surface. The first cryopanel 32 is accommodated in a cryopump housing 40. One end of the cryopump housing 40 is attached to the motor housing 21. A flange at another end of the cryopump housing 40 is attached to a gate valve (not shown) of the vacuum chamber 102. Any publicly known cryopump may be employed as the cryopump 10.

The compressor unit 50 includes a compressor main body 52 for compressing the working gas and a compressor motor 53 for driving the compressor main body 52. The compressor unit 50 includes a low pressure gas inlet 54 for receiving a low pressure working gas and a high pressure gas outlet 56 for discharging a high pressure working gas. The low pressure gas inlet 54 is connected through a low pressure channel 58 to a suction port of the compressor main body 52, and the high pressure gas outlet 56 is connected through a high pressure channel 60 to a discharge port of the compressor main body 52.

The compressor unit 50 includes a first pressure sensor 62 and a second pressure sensor 64. The first pressure sensor 62 is provided in the low pressure channel 58 to measure the pressure of the low pressure working gas, and the second pressure sensor 64 is provided in the high pressure channel 60 to measure the pressure of the high pressure working gas. The first pressure sensor 62 and the second pressure sensor 64 may be disposed at appropriate locations in the gas line 70 outside the compressor unit 50.

The gas line 70 includes a high pressure line 72 for supplying the working gas from the compressor unit 50 to the cryopump 10 and a low pressure line 74 for returning the working gas from the cryopump 10 to the compressor unit 50. The high pressure line 72 constitutes the piping connecting the high pressure gas inlet 24 of the refrigerator 12 with the high pressure gas outlet 56 of the compressor unit 50. The high pressure line 72 includes a main high pressure pipe extending from the compressor unit 50 and individual high pressure pipes branching from the main pipe and extending to the respective refrigerators 12. The low pressure line 74 constitutes the piping connecting the low pressure gas outlet 26 of the refrigerator 12 with the low pressure gas inlet 54 of the compressor unit 50. The low pressure line 74 includes a main low pressure pipe extending from the compressor unit 50 and individual low pressure pipes branching from the main pipe and extending to the respective refrigerators 12.

The compressor unit 50 collects the low pressure working gas discharged by the cryopump 10 through the low pressure line 74. The compressor main body 52 compresses the low pressure working gas to generate the high pressure working gas. The compressor unit 50 supplies the high pressure working gas through the high pressure line 72 to the cryopump 10.

The cryopump system 100 includes a control device 110 configured to control the operation thereof. The control device 110 is provided as an integral part of, or separately from, the cryopump 10 (or the compressor unit 50). The control device 110 includes, for example, a CPU for performing various arithmetic operations, a ROM for storing various control programs, a RAM for providing a work area to store data and execute programs, an input/output interface, and a memory. A publicly known controller with such a configuration may be used as the control device 110. The control device 110 may be a single controller or include a plurality of controllers each performing an identical or different function.

Figure 2:
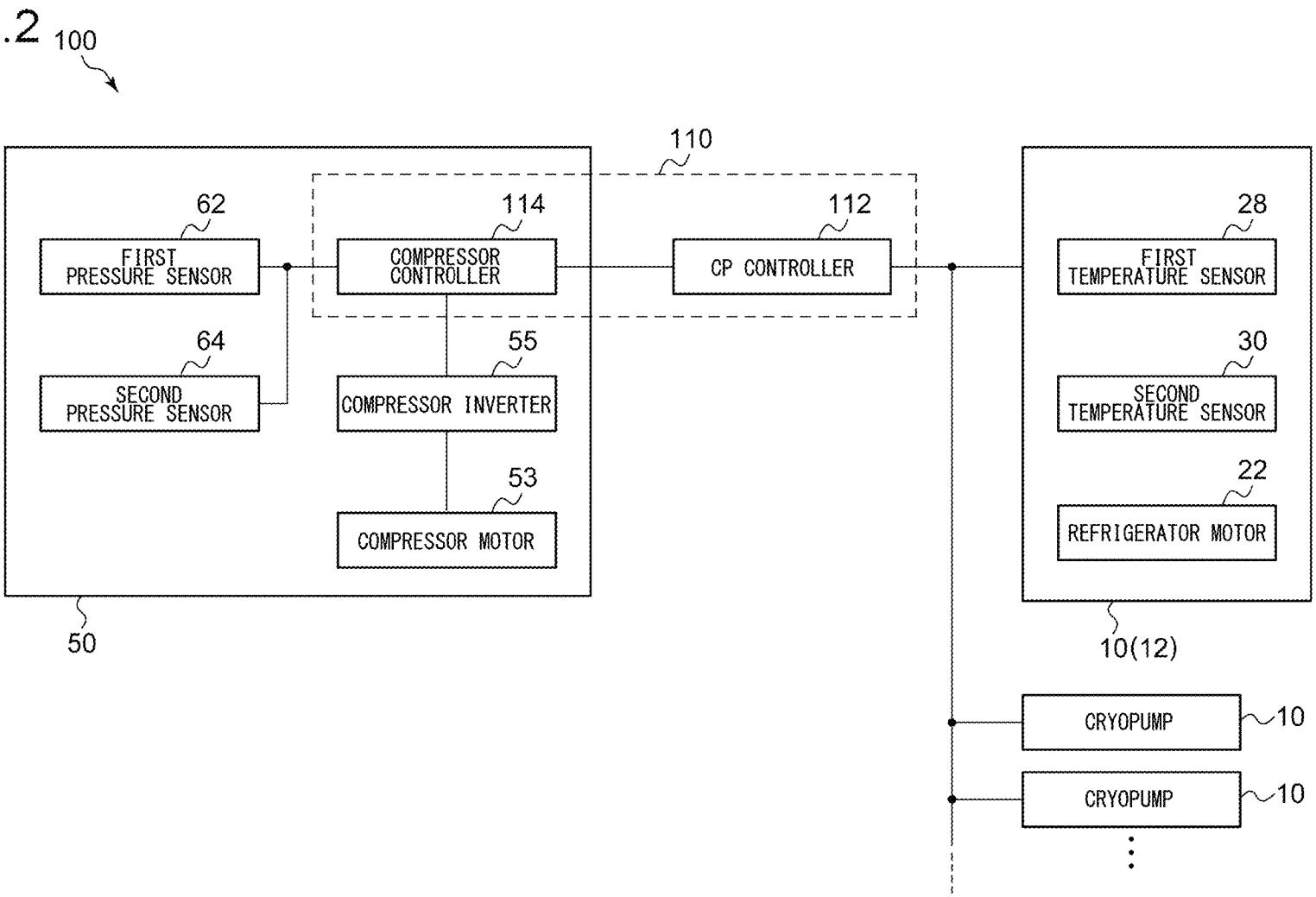
FIG. 2 is a block diagram illustrating an outline of a configuration of the control device for the cryopump system according to an embodiment of the present invention.

FIG. 2 is a block diagram illustrating an outline of a configuration of the control device 110 for the cryopump system 100 according to an embodiment of the present invention. FIG. 2 illustrates principal portions of the cryopump system 100 in connection with an embodiment of the present invention.

The control device 110 is provided to control the cryopump 10 (i.e., the refrigerator 12) and the compressor unit 50. The control device 110 includes a cryopump controller (hereinafter, also referred to as CP controller) 112 for controlling the operation of the cryopump 10, and a compressor controlling unit or a compressor controller 114 for controlling the operation of the compressor unit 50.

The CP controller 112 is configured to receive signals representing temperatures measured by the first temperature sensor 28 and the second temperature sensor 30 of the cryopump 10. For example, the CP controller 112 controls the cryopump 10 based on a measured temperature that has been received. In this case, for example, the CP controller 112 controls an operating frequency of the refrigerator 12 such that the measured temperature of the first (or second) temperature sensor 28 (30) agrees with a target temperature of the first (or second) cryopanel 32 (34). The rotational speed of the refrigerator motor 22 is controlled according to the operating frequency. This adjusts the number of thermal cycles per unit time (i.e., frequency) in the refrigerator 12. Accordingly, the temperature control in the cryopump 10 provides an adjustment of the flow rate of the working gas used in the refrigerator 12.

The compressor controller 114 is configured to provide pressure control. The compressor controller 114 is configured to receive signals representing pressures measured by the first pressure sensor 62 and the second pressure sensor 64 in order to provide the pressure control. The compressor controller 114 controls an operating frequency of the compressor main body 52 such that a measured value of pressure agrees with a target pressure value. The compressor unit 50 includes a compressor inverter 55 for changing the operating frequency of the compressor motor 53. The rotational speed of the compressor motor 53 is controlled in accordance with the operating frequency.

For example, the compressor controller 114 controls a pressure difference between the high pressure and the low pressure in the compressor main body 52 such that it is adjusted to a target pressure. Hereinafter, this may be referred to as constant pressure difference control. The compressor controller 114 controls the operating frequency of the compressor main body 52 to maintain the pressure difference constant. The target pressure difference may be changed as needed during constant pressure difference control.

In the constant pressure difference control, the compressor controller 114 determines a pressure difference between the pressure measured by the first pressure sensor 62 and the pressure measured by the second pressure sensor 64. The compressor controller 114 determines the operating frequency of the compressor motor 53 to cause the pressure difference to match the target value $\Delta P$. The compressor controller 114 controls the compressor inverter 55 and the compressor motor 53 so as to achieve the operating frequency.

According to pressure control, the revolution of the compressor motor 53 can be properly controlled in accordance with the flow rate of the working gas used in the refrigerator 12. This contributes to a reduction in the electric power consumption of the cryopump system 100.

In addition, according to the constant differential pressure control, the refrigerating capacity of the refrigerator 12 can be maintained at a target capacity because the differential pressure determines the refrigerating capacity of the refrigerator 12. Hence, the constant differential pressure control is particularly advantageous for the cryopump system 100 in that the refrigerating capacity of the refrigerator 12 can be maintained and the electric power consumption by the system can be reduced simultaneously.

Alternatively, the target pressure value may be a target value of the high pressure (or a target value of the low pressure). In this case, the compressor controller 114 performs a constant high pressure control (or a constant low pressure control) in which the rotational speed of the compressor motor 53 is controlled such that the pressure measured by the second pressure sensor 64 (or the first pressure sensor 62) agrees with the target high pressure value (or the target low pressure value).

Figure 3:
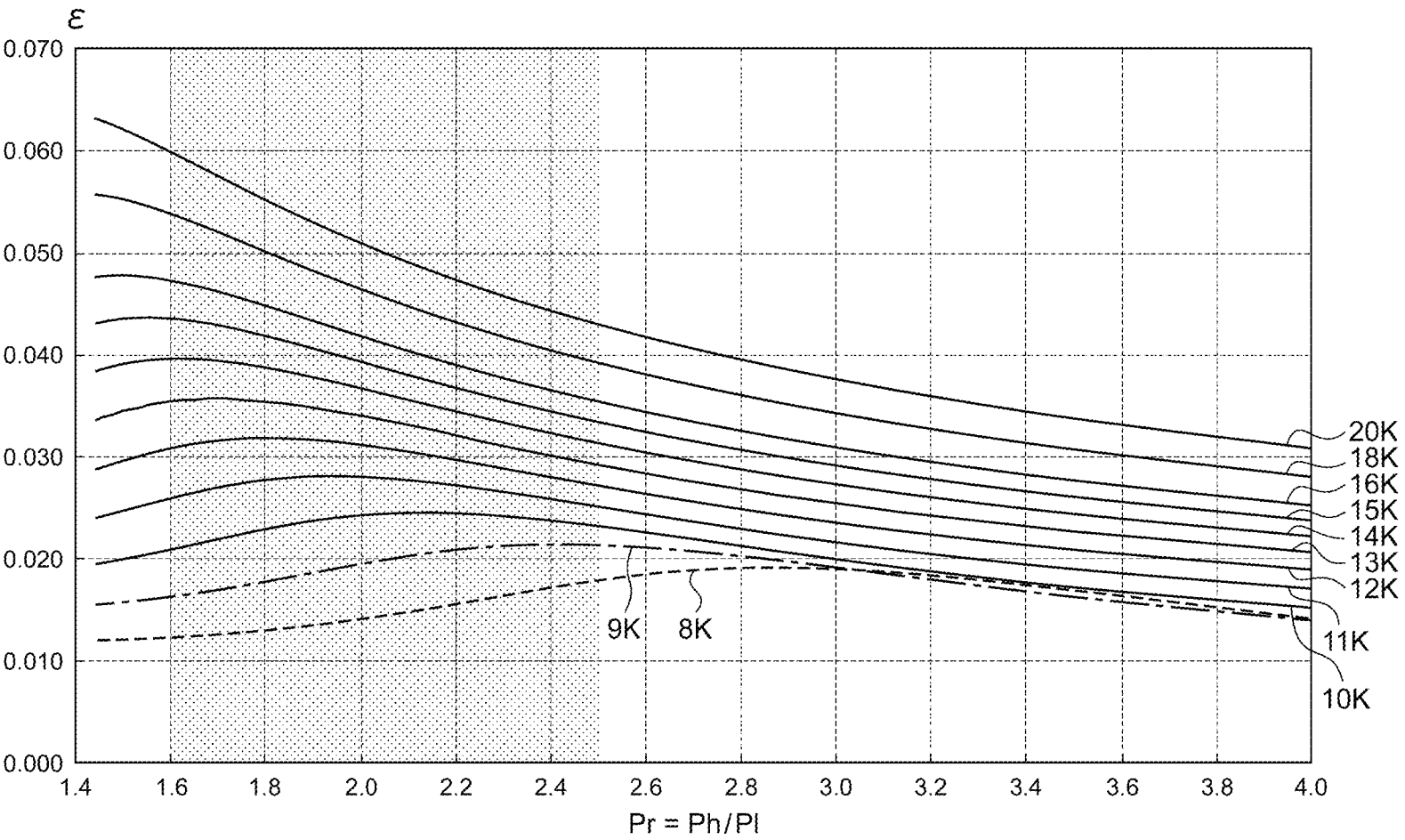
FIG. 3 is a graph illustrating the relationship between the refrigeration efficiency and the pressure ratio according to an embodiment of the present invention.

FIG. 3 is a graph illustrating the relationship between the refrigeration efficiency ε and the pressure ratio Pr according to an embodiment of the present invention. The graph is obtained by inventor's theoretical analysis of the cryopump system 100. In the analysis, the fact that the working gas (e.g., helium gas) is a real gas is taken into consideration. The refrigeration efficiency ε is given by ε=Q/W, where Q denotes the refrigeration work of the refrigerator 12 and W denotes the compression work of the compressor unit 50. The pressure ratio Pr is a ratio of the high pressure (i.e., discharge pressure) $P_h$ of the compressor main body 52 with respect to the low pressure (i.e., suction pressure) $P_l$ and is given by $Pr=P_h/P_l$.

The refrigeration efficiency ε is given by the following expression, using the pressure ratio $Pr=P_h/P_l$.

$$\varepsilon = A \times \frac{\alpha_v\left(\frac{P_h}{P_l} - 1\right)}{\frac{(\rho_{h,co} - \rho_{l,hl})}{P_l}\left[\left(\frac{P_h}{P_l}\right)^{\frac{k-1}{k}} - 1\right]}$$

where k denotes the specific heat ratio of the working gas, $\alpha_v$ denotes the coefficient of volumetric expansion, $\rho_{h,co}$ denotes the density of the working gas taken into the expansion chambers of the refrigerator 12, $\rho_{l,hl}$ denotes the density of the working gas taken into the compressor unit 50, and A denotes a coefficient including the working gas temperature. FIG. 3 shows variation of the refrigeration efficiency ε with respect to the pressure ratio Pr, when the working gas temperature is 8 K, 9 K, 10 K, 11 K, 12 K, 13 K, 14 K, 15 K, 16 K, 18 K, and 20 K, respectively. The low pressure $P_l$ is a predetermined value simulating the actual operation.

As shown in FIG. 3, the refrigeration efficiency ε has the maximum value at a certain pressure ratio. For example, given that the working gas temperature is 11 K, the refrigeration efficiency ε has the maximum value of about 0.028 when the pressure ratio Pr is about 1.9. Thus, in the typical temperature zone of the second stage 16 of the refrigerator 12 for the cryopump 10, i.e., from about 8 K to about 20 K, the pressure ratio Pr that maximizes the refrigeration efficiency ε is found.

Therefore, the compressor unit 50 according to an embodiment of the present invention is operated at a pressure ratio Pr selected in a pressure ratio range from about 1.6 to about 2.5. This allows the refrigerator 12 to be operated with the maximum or approximately maximum refrigeration efficiency ε. Accordingly, the cryopump system 100 having excellent energy saving performance can be provided.

The second stage 16 of the refrigerator 12 (i.e., the second cryopanel 34) is desirably cooled to a temperature zone from about 9 K to about 15 K during the vacuum pumping operation of the cryopump 10. In this temperature zone, the refrigeration efficiency ε has the maximum value in a pressure range from about 1.6 to about 2.5, as shown in FIG. 3. It is therefore possible to operate the refrigerator 12 with the maximum refrigeration efficiency ε. For example, under the temperature of 9 K, the refrigeration efficiency ε is maximum when the pressure ratio Pr is about 2.5. Further, under the temperature of 15 K, the refrigeration efficiency ε is maximum when the pressure ratio Pr is about 1.6.

More preferably, the compressor unit 50 may be operated at a pressure ratio Pr selected in a pressure ratio range from about 1.9 to about 2.1. In this case, the second stage 16 of the refrigerator 12 may be cooled to a temperature zone from about 10 K to about 12 K.

Meanwhile, in a typical design concept of cryopump system, only the refrigeration work Q of the refrigerator is taken into account. For example, a system is designed in order that the refrigeration work Q is maximized. The resultant operating pressure ratio of the compressor is normally about, for example 2.6 or higher (e.g., 3.0 or higher), which is outside the optimum range indicated above. Thus, according to the embodiment of the present invention, the operating pressure ratio of the compressor unit 50 is relatively low.

The high pressure $P_h$ of the compressor main body 52 may be about 2.8 MPa or higher and/or the low pressure $P_l$ of the compressor main body 52 may be about 1.4 MPa or higher. By ensuring that the high pressure $P_h$ and/or the low pressure $P_l$ of the compressor main body 52 are relatively high, it is easy to realize a relatively low optimum operating pressure ratio from about 1.6 to about 2.5 as described above under a desirable pressure difference between the high pressure $P_h$ and the low pressure $P_l$. For example, when the high pressure $P_h$ is 2.8 MPa and the low pressure $P_l$ is 1.4 MPa, the pressure ratio is 2 and the pressure difference is 1.4 MPa. The high pressure $P_h$ of the compressor main body 52 may be about 3 MPa or higher and/or the low pressure $P_l$ of the compressor main body 52 may be about 1.5 MPa or higher. For example, when the high pressure $P_h$ is 3 MPa and the low pressure $P_l$ is 1.5 MPa, the pressure ratio is 2 and the pressure difference is 1.5 MPa.

Figure 4:
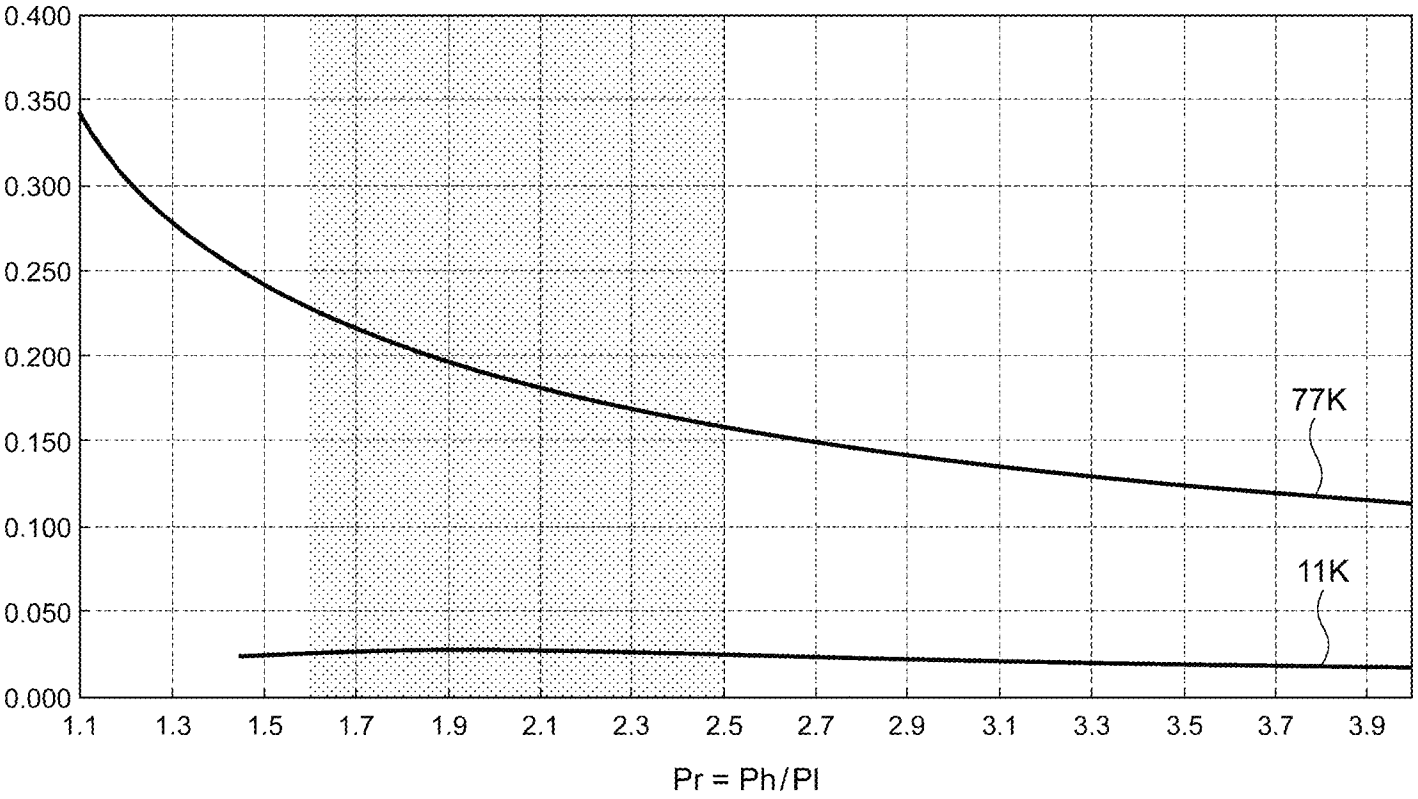
FIG. 4 is a graph illustrating the relationship between the refrigeration efficiency and the pressure ratio.

It is unique to the second stage cooling temperature of the refrigerator 12 for the cryopump that the refrigeration efficiency ε has the maximum value at a given pressure ratio Pr. FIG. 4 shows the relationship between the refrigeration efficiency ε and the pressure ratio Pr at 77 K (an example of the first stage cooling temperature of the refrigerator 12) in contrast to the relationship between the refrigeration efficiency ε and the pressure ratio Pr at 11 K shown in FIG. 3. As can be seen in FIG. 4, the maximum value of the refrigeration efficiency ε is not found at the first stage cooling temperature like 77 K.

Described above is an explanation based on an exemplary embodiment. The invention is not limited to the embodiment described above and it will be obvious to those skilled in the art that various design changes and variations are possible and that such modifications are also within the scope of the present invention.

The compressor unit 50 according to the embodiment may be operated at a selected constant pressure ratio Pr. Alternatively, the pressure ratio Pr may be adjusted during the operation of the compressor unit 50. In this case, the compressor unit 50 may be operated at a pressure ratio Pr that gives the maximum refrigeration efficiency ε corresponding to the measured temperature of the low temperature cryopanel.

The cryopump system 100 according to the embodiment described above includes a plurality of cryopumps 10. However, the cryopump system 100 according an embodiment may include only one cryopump 10.

The cryopump system 100 according to an embodiment may include a cold trap. In other words, the cryopump 10 and the cold trap may be connected to a common compressor unit 50. Thus, a cold trap may be used in the cryopump system 100.

It should be understood that the invention is not limited to the above-described embodiment, but may be modified into various forms on the basis of the spirit of the invention. Additionally, the modifications are included in the scope of the invention.

What is claimed is:

1. A cryopump system comprising:

at least one cryopump including a refrigerator including a low temperature cooling stage and a high temperature cooling stage, a low temperature cryopanel cooled by the low temperature cooling stage, and a high temperature cryopanel cooled by the high temperature cooling stage; and a compressor unit including a compressor main body that compresses a working gas to be supplied to the refrigerator, an operating frequency of the compressor main body being variable, wherein the compressor unit is operated such that a pressure ratio between a high pressure of the compressor main body and a low pressure of the compressor main body is in a range between 1.6 and 2.5, wherein the refrigerator is operated with a refrigeration efficiency as a function of the pressure ratio to cool the low temperature cryopanel to a temperature zone between 9 K and 15 K, wherein the refrigeration efficiency is defined as ε=Q/W, where Q is refrigeration work of the refrigerator and W is compression work of the compressor unit, wherein the cryopump system is configured such that, during operation of the compressor unit at a pressure ratio selected from the range between 1.6 and 2.5, the refrigeration efficiency is maximized at any temperature in the temperature zone between 9 K and 15 K.

2. The cryopump system according to claim 1, further comprising:

another cryopump that includes another refrigerator, another low temperature cryopanel, and another high temperature cryopanel.

3. The cryopump system according to claim 1, further comprising:

a compressor controller that controls the operating frequency of the compressor main body so that a pressure difference between the high pressure and the low pressure of the compressor main body agrees with a target value.

4. The cryopump system according to claim 1, wherein the high pressure of the compressor main body is 2.8 MPa or higher.

5. The cryopump system according to claim 1, wherein the low pressure of the compressor main body is 1.4 MPa or higher.

6. The cryopump system according to claim 1, wherein the compressor unit includes a compressor inverter that changes the operating frequency of the compressor main body.

7. A method of operating a cryopump system, the cryopump system comprising:

at least one cryopump including a refrigerator including a low temperature cooling stage and a high temperature cooling stage, a low temperature cryopanel cooled by the low temperature cooling stage, and a high temperature cryopanel cooled by the high temperature cooling stage; and a compressor unit including a compressor main body that compresses a working gas to be supplied to the refrigerator, an operating frequency of the compressor main body being variable, the method comprising:

operating the compressor main body such that a pressure ratio between a high pressure of the compressor main body and a low pressure of the compressor main body is in a range between 1.6 and 2.5; and operating the refrigerator with a refrigeration efficiency as a function of the pressure ratio to cool the low temperature cryopanel to a temperature zone between 9 K and 15 K, wherein the refrigeration efficiency is defined as ε=Q/W, where Q is refrigeration work of the refrigerator and W is compression work of the compressor unit, wherein, during operation of the compressor unit at a pressure ratio selected from the range between 1.6 and 2.5, the refrigeration efficiency is maximized at any temperature in the temperature zone between 9 K and 15 K.

8. A cryopump system:

at least one cryopump including a refrigerator including a low temperature cooling stage and a high temperature cooling stage, a low temperature cryopanel cooled by the low temperature cooling stage, and a high temperature cryopanel cooled by the high temperature cooling stage; and a compressor unit including a compressor main body that compresses a working gas to be supplied to the refrigerator, an operating frequency of the compressor main body being variable, wherein the compressor unit is operated such that a pressure ratio between a high pressure of the compressor main body and a low pressure of the compressor main body is in a range between 1.6 and 2.5, wherein the refrigerator is operated with a refrigeration efficiency as a function of the pressure ratio to cool the low temperature cryopanel to a temperature zone between 9 K and 15 K, wherein the refrigeration efficiency is given by:

$$\varepsilon = A \times \frac{\alpha_v\left(\frac{P_h}{P_l} - 1\right)}{\frac{(\rho_{h,co} - \rho_{l,hl})}{P_l}\left[\left(\frac{P_h}{P_l}\right)^{\frac{k-1}{k}} - 1\right]},$$

where

"A" denotes a coefficient including the working gas temperature,

"$\alpha_v$," denotes the coefficient of volumetric expansion,

"$P_h$" is the high pressure of the compressor main body,

"$P_l$" is the low pressure of the compressor main body,

"k" denotes the specific heat ratio of the working gas,

"$\rho_{1,hl}$" denotes the density of the working gas taken into the compressor unit, and "$\rho_{h,co}$" denotes the density of the working gas taken into an expansion chamber of the refrigerator, wherein the cryopump system is configured such that, during operation of the compressor unit at a pressure ratio selected from the range between 1.6 and 2.5, the refrigeration efficiency is maximized at any temperature in the temperature zone between 9 K and 15 K.

9. The cryopump system according to claim 1, wherein the refrigeration efficiency has a maximum value at the pressure ratio.

10. The cryopump system according to claim 1, wherein the compressor unit is operated such that a pressure ratio between high pressure and low pressure of the compressor main body is in a range between 1.9 and 2.1, and wherein the refrigerator is operated with a refrigeration efficiency as a function of the pressure ratio to cool the low temperature cryopanel to the temperature zone between 10 K and 12 K.

11. The cryopump system according to claim 1, wherein the high pressure ratio is a discharge pressure of the compressor main body.

12. The cryopump system according to claim 1, wherein the low pressure ratio is a suction pressure of the compressor main body.

13. The cryopump system according to claim 7, wherein the high pressure ratio is a discharge pressure of the compressor main body.

14. The cryopump system according to claim 7, wherein the low pressure ratio is a suction pressure of the compressor main body.

15. The cryopump system according to claim 8, wherein the high pressure ratio is a discharge pressure of the compressor main body.

16. The cryopump system according to claim 8, wherein the low pressure ratio is a suction pressure of the compressor main body.

* * * * *